US007525056B2

(12) United States Patent
Chiba et al.

(10) Patent No.: US 7,525,056 B2
(45) Date of Patent: Apr. 28, 2009

(54) KEY SWITCH STRUCTURE

(75) Inventors: Toshimi Chiba, Gunma (JP); Zenzo Tozuka, Gunma (JP); Shigeru Yamada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/706,973

(22) Filed: Feb. 16, 2007

(65) Prior Publication Data

US 2007/0235306 A1 Oct. 11, 2007

(30) Foreign Application Priority Data

Apr. 7, 2006 (JP) ..... 2006-106655

(51) Int. Cl.
*H01H 9/00* (2006.01)

(52) U.S. Cl. ..... 200/314

(58) Field of Classification Search ..... 200/310–314, 200/317, 512–520, 5 A, 5 R, 341, 237, 344, 200/242, 245, 253
See application file for complete search history.

(56) References Cited

U.S. PATENT DOCUMENTS 4,141,058 A * 2/1979 Mizohata et al. ..... 362/558
5,961,198 A * 10/1999 Hira et al. ..... 362/621
6,040,822 A * 3/2000 Decker ..... 345/168
6,686,549 B2 * 2/2004 Douzono et al. ..... 200/341
6,860,612 B2 * 3/2005 Chiang et al. ..... 200/314
7,071,433 B2 * 7/2006 Holscher ..... 200/314
2004/0085749 A1 * 5/2004 Parker et al. ..... 362/31

FOREIGN PATENT DOCUMENTS

JP 2002251937 9/2002

* cited by examiner

*Primary Examiner*—Edwin A. Leon
(74) *Attorney, Agent, or Firm*—Venable LLP; James R. Burdett; Kyle D. Petaja

(57) ABSTRACT

A key switch structure includes a key top, a membrane sheet, a plate member, and a light source. The key top on which an unpainted character portion that is permeable to light is formed. The membrane sheet comprises a contact portion and is permeable to light. The plate member is disposed below the membrane sheet and is permeable to light. The light source is disposed below the plate member. The unpainted character portion of the key top is lighted via the plate member and the membrane sheet by causing the light source to emit light.

14 Claims, 12 Drawing Sheets

KEY SWITCH STRUCTURE

CROSS-REFERENCE TO RELATED APPLICATION

This application claims priority under 35 USC 119 from Japanese Patent Application No. 2006-106655, the disclosure of which is incorporated by reference herein.

BACKGROUND OF THE INVENTION

1. Field of the Invention

The present invention relates to a key switch structure of a keyboard that is used as an input device in an information processing device, a measurement instrument, or a medical instrument, and in particular relates to a key switch structure including a lighting function that can ensure good operability even in a dark environment.

2. Description of the Related Art

Conventionally, the development of keyboard devices that can ensure good operability even in a dark environment has been carried out. For example, there is a keyboard device of the structure shown in FIG. 17. To describe this keyboard device using FIG. 17, a character or symbol is printed on the upper surface of a key top 1, an elastic member 2 and a link mechanism 3 are disposed below the key top 1, and a membrane sheet 5 and a reinforcement plate 6 including a contact portion 4 are disposed below the elastic member 2 and the link mechanism 3. An EL light emitting portion 7 is disposed on the upper portion of the membrane sheet 5.

The EL light emitting portion 7 is formed by printing on a dedicated sheet 8, and light is emitted from the underside of the key top 1 by the EL light emitting portion 7. As a result of light being emitted from the underside of the key top 1, the character or symbol printed on the key top 1 is brightly lighted and can be seen. Examples of publications that disclose a key switch that uses an EL element to light the key top 1 include Japanese Patent Application Publication (JP-A) No. 2002-251937.

However, in the above-described conventional keyboard device of the key switch structure using an EL element, it is common for the lighting lifespan of the EL element to be about 3,000 hours, which is relatively short, and there has been the problem that the key switch structure cannot be employed in an information processing device, a measurement instrument, or a medical instrument whose use for several years is to be assured. Moreover, there has also been the problem that the product becomes expensive because an inverter that supplies high-frequency/high-voltage alternating current in order to cause the EL element to emit light is necessary.

Further, when an EL element is disposed in a keyboard including a link mechanism portion widely employed in personal computers, it is difficult to dispose the EL element directly below the link mechanism portion disposed on the underside of the keyboard, and there is no choice but to dispose the EL element in a place other than directly below the link mechanism portion. For that reason, there has also been the problem that it is difficult to obtain lighting of the keyboard that is uniform and good.

SUMMARY OF THE INVENTION

The present invention has been made in view of the above circumstances and provides a key switch structure.

A first aspect of the present invention provides a key switch structure comprising: a key top on which an unpainted character portion that is permeable to light is formed; a membrane sheet that comprises a contact portion and is permeable to light; a plate member that is disposed below the membrane sheet and is permeable to light; and a light source disposed below the plate member, wherein the unpainted character portion of the key top is lighted via the plate member and the membrane sheet by causing the light source to emit light.

BRIEF DESCRIPTION OF THE DRAWINGS

Exemplary embodiments of the present invention will be described in detail based on the following figures, wherein:

FIGS. 3A and 3B are explanatory diagrams showing positional relationships between an unpainted character portion and an LED;

DETAILED DESCRIPTION OF THE INVENTION

Figure 1:
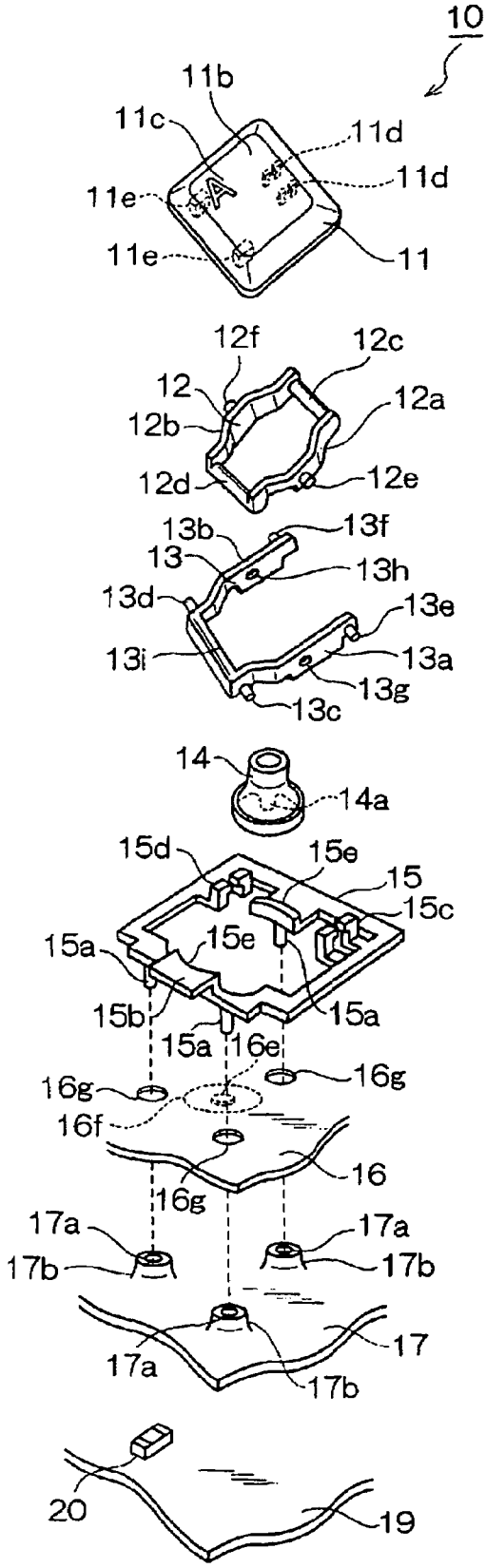
FIG. 1 is an exploded perspective diagram showing a key switch structure of a first exemplary embodiment.

Exemplary embodiments of the present invention will be described below in accordance with the drawings. The same reference numerals will be given to elements in common throughout the drawings. FIG. 1 is an exploded perspective diagram showing a key switch structure of a first exemplary embodiment, and FIG. 2 is a cross-sectional diagram showing the key switch structure of the first exemplary embodiment.

Figure 2:
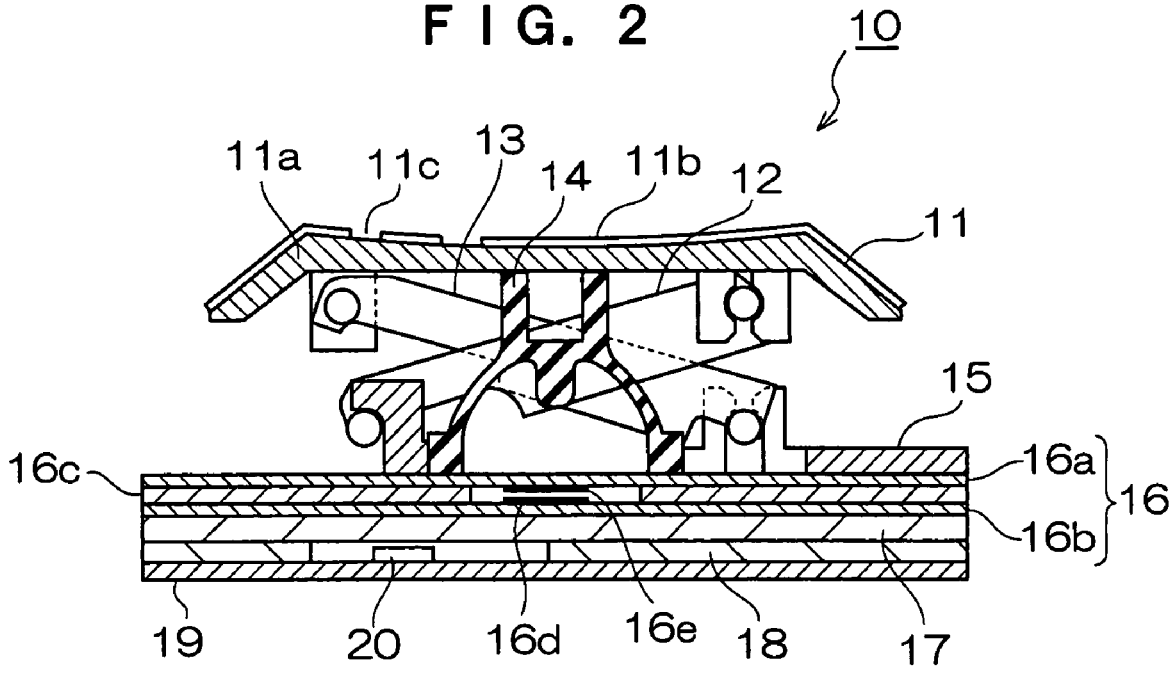
FIG. 2 is a cross-sectional diagram showing the key switch structure of the first exemplary embodiment.

In FIG. 1 and FIG. 2, a key switch 10 of the first exemplary embodiment is configured by: a key top 11; a first link member 12 disposed so as to be slidable with respect to the key top 11; a second link member 13 disposed so as to be rotatable with respect to the key top 11; a rubber dome (elastic member) 14 that bends when the key top 11 is depressed and causes the key top 11 to return to its original position when the depressing force is released; a holder 15 that holds the first and second link members 12 and 13; a membrane sheet 16 that includes a contact portion directly below the rubber dome 14; a back plate (plate member) 17 that includes holes 17*a* that fix welding-use pins 15*a* of the holder 15 and which is formed by a material that is permeable to light; and a printed wiring board 19 disposed via a spacer 18 (shown in FIG. 2) on the underside of the back plate 17.

As shown in FIG. 2, the key top 11 includes: a body portion 11*a* formed by a transparent or semitransparent resin whose degree of permeability to light has been optionally adjusted; a painted portion 11*b* that is formed on the upper part of the body portion 11*a* and to which has been applied paint of a single color or numerous colors adjusted in order to control permeability to light; and an unpainted character portion 11*c* on which an unpainted character or an unpainted symbol has been formed by removing paint in the form of a character or symbol by laser marking or the like. It will be noted that the unpainted character portion 11*c* includes all characters, symbols, numerals and the likes that are ordinarily printed on the upper surface of the key top 11.

Rotation support portions 11*d*, which rotatably support one end of the first link member 12, and slide support portions 11*e*, which support one end of the second link member 13 such that the second link member 13 is rotatable and also movable in the horizontal direction, are disposed on the underside of the key top 11. The first link member 12 includes a pair of leg portions 12*a* and 12*b*. A first coupling rod 12*c* that is inserted into and supported by the rotation support portions 11*d* of the key top 11 is disposed on one end of the leg portions 12*a* and 12*b* so as to couple together the leg portions 12*a* and 12*b*. Similarly, a second coupling rod 12*d* is disposed on the other end of the leg portions 12*a* and 12*b* so as to couple together the leg portions 12*a* and 12*b*. Moreover, a shaft 12*e* and a shaft 12*f* are respectively disposed on the outer surfaces of the leg portions 12*a* and 12*b* on a line connecting the first coupling rod 12*c* and the second coupling rod 12*d* and at positions equidistant with respect to the coupling rods 12*c* and 12*d*.

The second link member 13 includes a pair of leg portions 13*a* and 13*b*. First support protrusions 13*c* and 13*d* that are supported in the slide support portions 11*e* of the key top 1 so as to be rotatable and also movable parallel in the horizontal direction are disposed facing outward on one end of the leg portions 13*a* and 13*b*. Second support protrusions 13*e* and 13*f* are disposed facing outward on the other end of the leg portions 13*a* and 13*b* at equal distances between both of the coupling rods 12*c* and 12*d* of the first link member 12. Further, shaft holes 13*g* and 13*h* are disposed on a line connecting the first support protrusions 13*c* and 13*d* and the second support protrusions 13*e* and 13*f* and at positions equidistant with respect to the support protrusions 13*c* and 13*d* and 13*e* and 13*f*. Moreover, the leg portions 13*a* and 13*b* are coupled together by a coupling portion 13*i* at the side further towards the distal end than the first support protrusions 13*c* and 13*d*.

The rubber dome 14 is formed in a substantial cup shape using rubber or the like as material, and a contact depression portion 14*a* is formed protruding downward in the center portion of the inner surface of the rubber dome 14. The holder 15 is divided into one key unit and formed in a frame shape, and a slide guide 15*b* for supporting the second coupling rod 12*d* of the first link member 12 such that the second coupling rod 12*d* is rotatable and also movable parallel in the horizontal direction is disposed in the vicinity of one end of the holder 15. Rotation guides 15*c* and 15*d* that support the second support protrusions 13*e* and 13*f* of the second link member 13 such that the second support protrusions 13*e* and 13*f* may freely rotate are disposed in the vicinity of the other end of the holder 15.

Further, circular arc-shaped guide walls 15*e* that fix the outer peripheral portion of the rubber dome 14 are disposed facing each other in the centers of both ends of the holder 15. Moreover, welding-use pins 15*a* of a predetermined length are formed at plural places on the underside of the holder 15 so as to surround through holes 16*f* in the membrane sheet 16.

As shown in FIG. 2, the membrane sheet 16 comprises two flexible sheets 16*a* and 16*b* and a spacer sheet 16*c* that is sandwiched between the two flexible sheets 16*a* and 16*b*. Plural through holes 16*f* are disposed in the spacer sheet 16*c* in correspondence to plural keys. Each of the through holes 16*f* forms a space between the two flexible sheets 16*a* and 16*b*. A fixed contact 16*d* is disposed in the flexible sheet 16*b* at the back plate 17 side and a movable contact 16*e* is disposed in the flexible sheet 16*a* at the rubber dome 14 side such that the fixed contact 16*d* and the movable contact 16*e* are positioned facing each other inside the space formed by the through hole 16*f*.

The fixed contact 16*d* and the movable contact 16*e* configure contact portions. Further, plural clear holes 16*g* are disposed in the membrane sheet 16 such that they are positioned around the through hole 16*f*. The surface of the membrane sheet 16 is formed in a protrusion—depression shape, and the entire membrane sheet 16 is formed from a member permeable to light.

The back plate 17 is disposed below, with the above-described parts being placed thereon, and is formed by a member that is permeable to light. Spacer protrusions 17*b* of the same thickness as the membrane sheet 16 are formed on the back plate 17 in correspondence to the clear holes 16*g* in the membrane sheet 16. Holes 17*a* through which the welding-use pins 15*a* of the holder 15 pass are disposed in, such that they penetrate, the centers of the spacer protrusions 17*b*. Moreover, recessed portions (counterbores) are formed around the holes 17*a* on the underside of the back plate 17. The upper surface of the back plate 17 is formed in a protrusion—depression shape and diffuses upward the light that has permeated the back plate 17 from below.

Figure 3A:
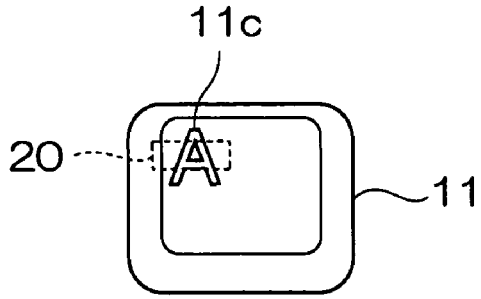

The printed wiring board 19 is disposed below the back plate 17. A light emitting diode (LED) 20 is disposed on the printed wiring board 19. As shown in FIGS. 3A and 3B, the LED 20 is disposed directly below the unpainted character portion 11*c* of the key top 11 in a state where the key switch 10 has been assembled. FIGS. 3A and 3B are explanatory diagrams showing positional relationships between the unpainted character portion 11*c* of the key top 11 and the LED 20. FIG. 3A shows an example where the LED 20 is disposed horizontally long, and FIG. 3B shows an example where the LED 20 is disposed vertically long.

Figure 4:
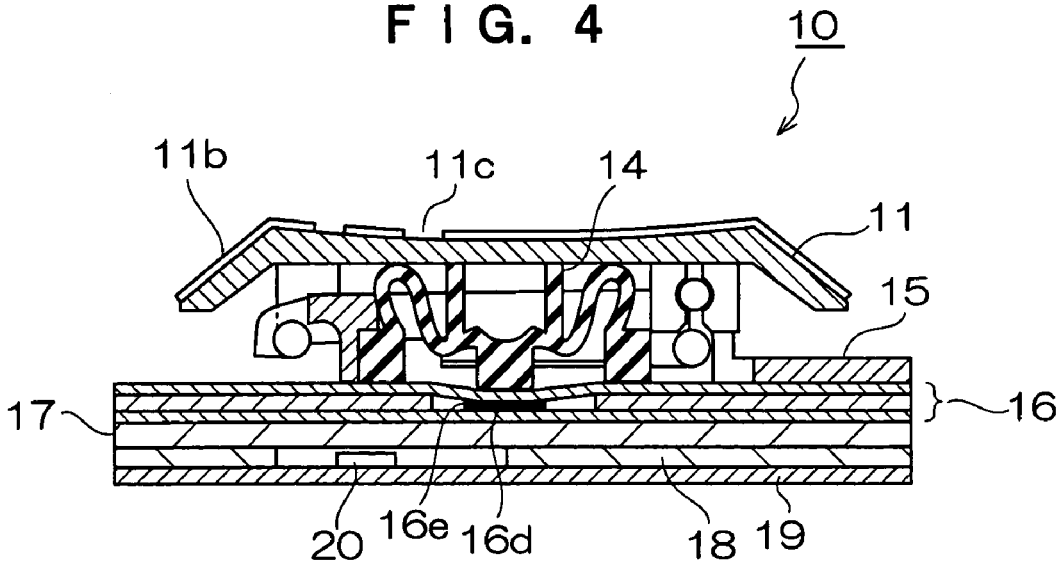
FIG. 4 is a cross-sectional diagram showing a switch-closed state.

Next, operation will be described. In FIG. 2, when the key top 11 is depressed from above by an arbitrary load, the key top 11 moves downward, whereby the rubber dome 14 bends and, as shown in FIG. 4, the contact depression portion 14*a* of the rubber dome 14 presses against the contact portions 16*d* and 16*e* of the membrane sheet 16. Thus, the switch becomes closed. Further, due to the first link member 12 and the second link member 13, no matter which part of the upper portion of the key switch 11 is depressed, the key top 11 moves downward while maintaining its horizontal state so that a switch-closed state is obtained. FIG. 4 is a cross-sectional diagram showing a switch-closed state.

Figure 5:
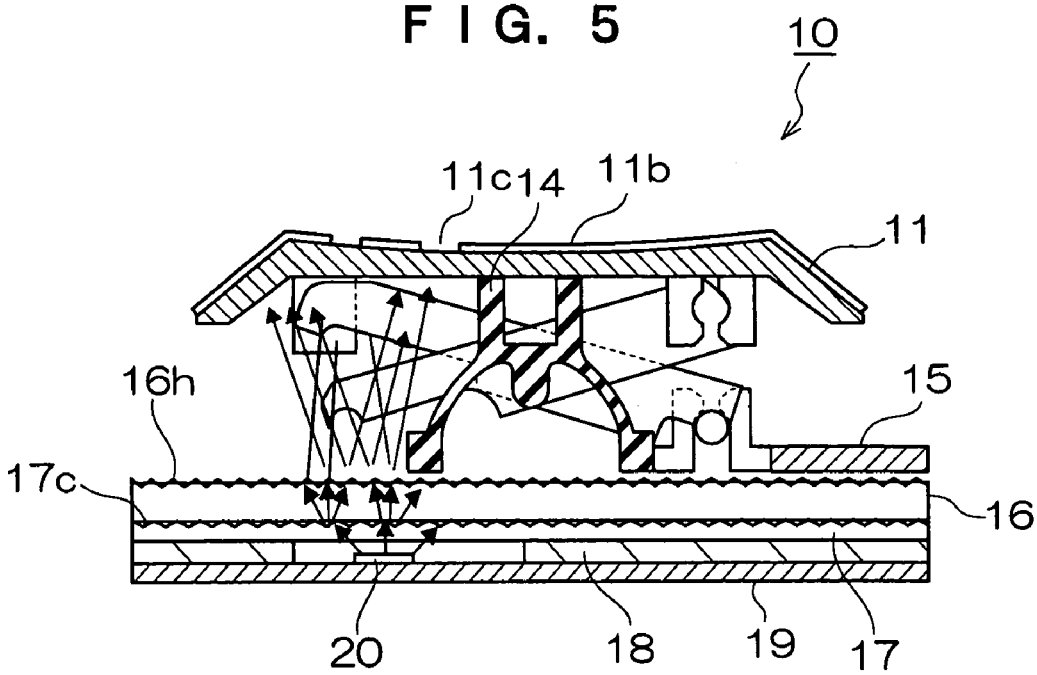
FIG. 5 is an explanatory diagram showing a lighted state in the first exemplary embodiment.

FIG. 5 is an explanatory diagram showing a lighted state in the first exemplary embodiment. In FIG. 5, the LED 20 disposed on the printing wiring board 19 lights up when an unillustrated power source is turned ON. The light emitted from the LED 20 first passes through the back plate 17 that is formed by a transparent resin. Because the surface of the back plate 17 is formed in a protrusion—depression shape 17*c*, the light passing through the back plate 17 is diffused as indicated by the arrows when it emerges from the back plate 17.

The light that has passed through and been diffused by the back plate 17 passes through the membrane sheet 16 because the membrane sheet 16 is permeable to light. The light passing at this time is again diffused by protrusions—depressions 16*h* in the surface of the membrane sheet 16 when it emerges from the membrane sheet 16. Additionally, some of the diffused light slips through the first link member 12 and the second link member 13 from the outside of the rubber dome 14 and reaches the underside of the key top 11.

The unpainted character portion 11*c* is formed on the key top 11, and when light strikes the unpainted character portion 11*c* from the underside, the shape of the character or symbol formed on the upper surface of the key top 11 is lighted and can be seen.

The light emitted from the LED 20 has extremely strong directionality, but according to the first exemplary embodiment, because the light emitted from the LED 20 disposed on the printed wiring board 19 is diffused by the protrusions—depressions 17*c* in the surface of the back plate 17 that is formed by a transparent resin when the light passes through the back plate 17 and is also diffused by the protrusions—depressions 16*h* in the surface of the membrane sheet 16 when the light passes through the membrane sheet 16, the light slips through the first and second link members 12 and 13 disposed on the upper portion of the membrane sheet 16 and can reach the underside of the key top 11. As a result, it becomes possible to light the unpainted character portion 11*c* formed on the key top 11. Because the light is finely diffused, the light lighting the unpainted character portion 11*c* becomes uniform, and the character or symbol can be easily seen when seen from above the key top 11.

Figure 6:
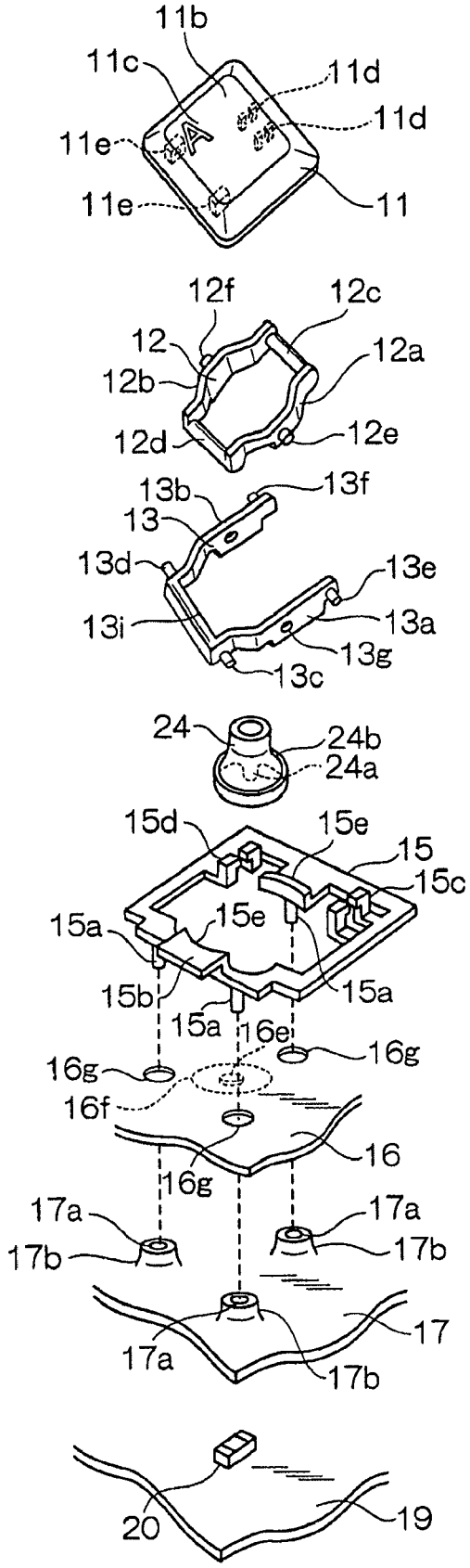
FIG. 6 is an exploded perspective diagram showing a key switch structure of a second exemplary embodiment.

Next, a second exemplary embodiment will be described. FIG. 6 is an exploded perspective diagram showing a key switch structure of the second exemplary embodiment. In FIG. 6, similar to the first exemplary embodiment, a key top 11 includes: a body portion 11*a* formed by a transparent or semitransparent resin whose degree of permeability to light has been optionally adjusted; a painted portion 11*b* that is formed on the upper part of the body portion 11*a* and to which has been applied paint of a single color or numerous colors adjusted in order to control permeability to light; and an unpainted character portion 11*c* on which an unpainted character or an unpainted symbol has been formed by removing paint in the form of a character or symbol by laser marking or the like.

Figure 7A:
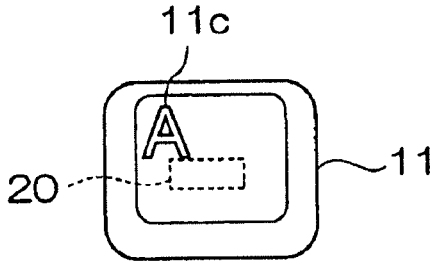
FIGS. 7A and 7B are explanatory diagrams showing positional relationships between a key top and an LED.
Figure 7B:
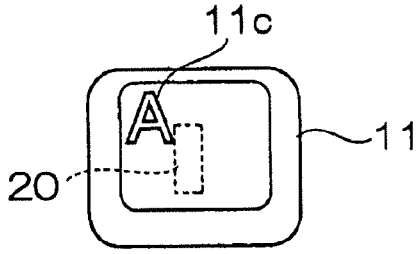

A rubber dome 24 is formed in a substantial cup shape by a transparent material, and a contact depression portion 24*a* is formed protruding downward in the center portion of the inner surface of the rubber dome 24. Fine protrusions—depressions are formed in the surface of the rubber dome 24. Further, an LED 20 is disposed on a lowermost printed wiring board 19. As shown in FIGS. 7A and 7B, the LED 20 is disposed directly below the center of the key top 11 in a state where the key switch has been assembled. By disposing the LED 20 directly below the center of the key top 11, the LED 20 becomes positioned directly below the contact portion of the rubber dome 24 and the membrane sheet 16. It will be noted that FIGS. 7A and 7B are explanatory diagrams showing positional relationships between the key top 11 and the LED 20. FIG. 7A shows an example where the LED 20 is disposed horizontally long, and FIG. 7B shows an example where the LED 20 is disposed vertically long. The remaining configuration is the same as that of the first exemplary embodiment.

Figure 8:
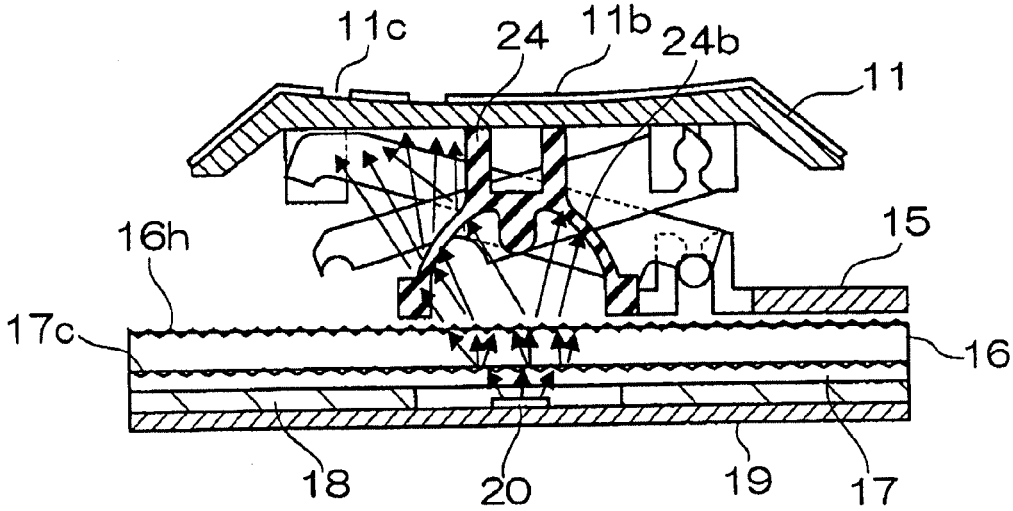
FIG. 8 is an explanatory diagram showing a lighted state in the second exemplary embodiment.

Next, operation will be described. Here, lighting by the LED 20 will be described. FIG. 8 is an explanatory diagram showing a lighted state in the second exemplary embodiment. In FIG. 8, the LED 20 disposed on the printing wiring board 19 lights up when an unillustrated power source is turned ON. The light emitted from the LED 20 first passes through the back plate 17 that is formed by a transparent resin. Because the surface of the back plate 17 is formed in the protrusion—depression shape 17*c*, the light passing through the back plate 17 is diffused as indicated by the arrows when it emerges from the back plate 17.

The light that has passed through and been diffused by the back plate 17 passes through the membrane sheet 16 because the membrane sheet 16 is permeable to light. The light passing at this time is again diffused by the protrusions—depressions 16*h* in the surface of the membrane sheet 16 when it emerges from the membrane sheet 16. Additionally, the diffused light enters the inside of the rubber dome 24 and passes through the rubber dome 24. The light passing at this time is further diffused by protrusions—depressions 24*b* in the surface of the rubber dome 24 when it emerges from the rubber dome 24. The diffused light slips through the first link member 12 and the second link member 13 and reaches the underside of the key top 11.

The unpainted character portion 11*c* is formed on the key top 11, and when light strikes the unpainted character portion 11*c*, the shape of the character or symbol formed on the upper surface of the key top 11 is lighted and can be seen.

In this manner, according to the second exemplary embodiment, because the light emitted from the LED 20 disposed on the printed wiring board 19 is diffused by the protrusions—depressions 17*c* in the surface of the back plate 17 that is formed by a transparent resin when it passes through the back plate 17, is further diffused by the protrusions—depressions 16*h* in the surface of the membrane sheet 16 when it passes through the membrane sheet 16, and is further diffused by the protrusions—depressions 24*b* in the surface of the rubber dome 24 when it passes through the rubber dome 24, the light slips through the first and second link members 12 and 13 disposed on the upper portion of the membrane sheet 16 and can reach the underside of the key top 11. As a result, it becomes possible to light, more uniformly than in the first exemplary embodiment, the unpainted character portion 11*c* formed on the key top 11.

It will be noted that, although an example was described in the second exemplary embodiment where the LED 20 was disposed directly below the center of the key top 11, in the case of a large key, sometimes the position where the character or symbol on the key top 11 is formed is greatly removed from the center position of the key top, so in this case, the LED 20 may be disposed substantially directly below the position where the character or symbol is formed.

Figure 9:
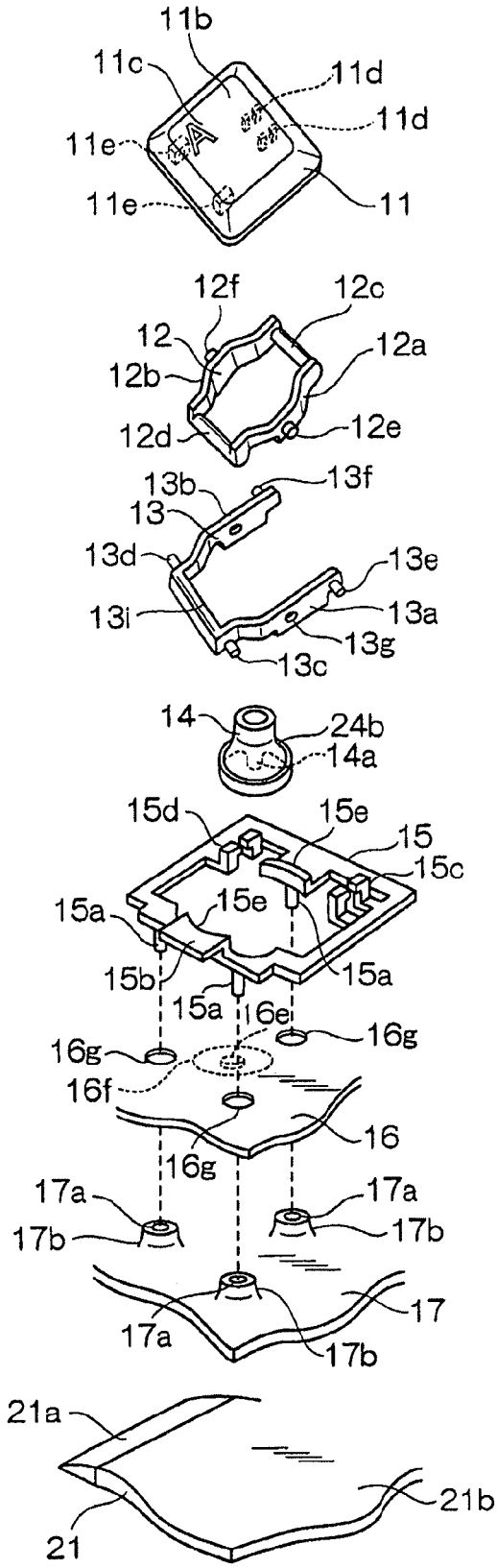
FIG. 9 is an exploded perspective diagram showing a key switch structure of a third exemplary embodiment.

Next, a third exemplary embodiment will be described. FIG. 9 is an exploded perspective diagram showing a key switch structure of the third exemplary embodiment. In FIG. 9, similar to the first exemplary embodiment, a key top 11 includes: a body portion 11*a* formed by a transparent or semitransparent resin whose degree of permeability to light has been optionally adjusted; a painted portion 11*b* that is formed on the upper part of the body portion 11*a* and to which has been applied paint of a single color or numerous colors adjusted in order to control permeability to light; and an unpainted character portion 11*c* on which an unpainted character or an unpainted symbol has been formed by removing paint in the form of a character or symbol by laser marking or the like.

A backlight unit 21 is disposed below the back plate 17. The backlight unit 21 emits light uniformly with respect to the entire underside of the back plate 17, and is configured by a fluorescent tube 21*a* that is a light emitting source and by a reflective plate 21*b*. The remaining configuration is the same as that of the first exemplary embodiment.

Figure 10:
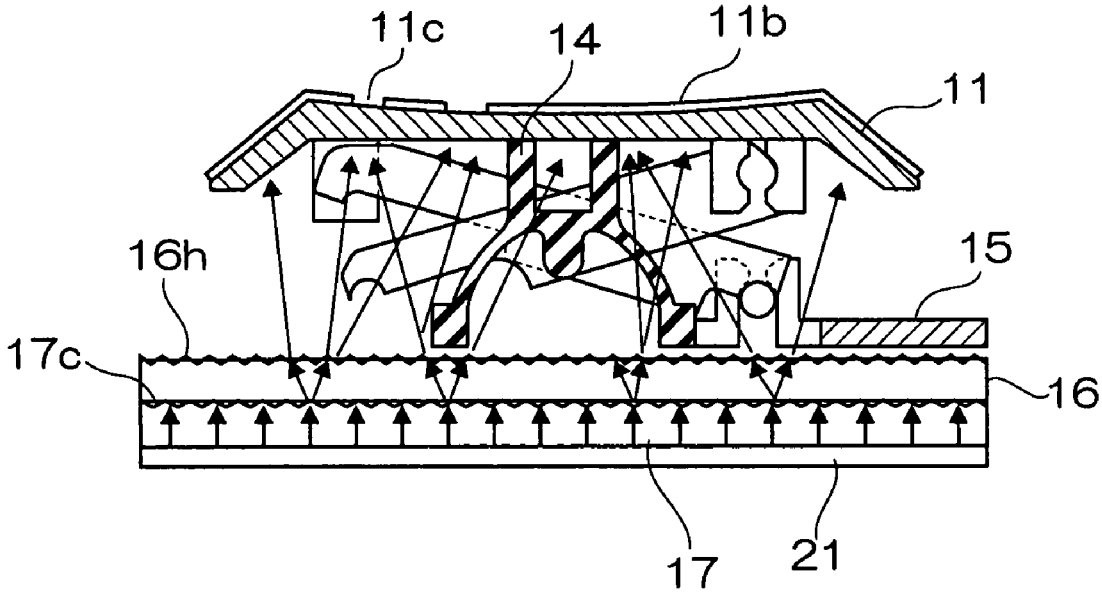
FIG. 10 is an explanatory diagram showing a lighted state in the third exemplary embodiment.

FIG. 10 is an explanatory diagram showing a lighted state in the third exemplary embodiment. In FIG. 10, the fluorescent tube 21*a* of the backlight unit 21 lights up when an unillustrated power source is turned ON. The light emitted from the fluorescent tube 21*a* is reflected by the reflective plate 21*b* and first passes uniformly upward through the back plate 17 that is formed by a transparent resin. Because the surface of the back plate 17 is formed in the protrusion—depression shape 17*c*, the light passing through the back plate 17 is diffused as indicated by the arrows when it emerges from the back plate 17.

The light that has passed through and been diffused by the back plate 17 passes through the membrane sheet 16 because the membrane sheet 16 is permeable to light. The light passing at this time is again diffused by the protrusions—depressions 16*h* in the surface of the membrane sheet 16 when it emerges from the membrane sheet 16. Additionally, some of the diffused light slips through the first link member 12 and the second link member 13 from the outside of the rubber dome 14 and reaches the underside of the key top 11.

The unpainted character portion 11*c* is formed on the key top 11, and when light strikes the unpainted character portion 11*c*, the shape of the character or symbol formed on the upper surface of the key top 11 is lighted and can be seen.

In the third exemplary embodiment, because the light emitted from the backlight unit 21 passes uniformly through the back plate 17 and is thereafter diffused and reaches the underside of the key top 11 in the same manner as in the first exemplary embodiment, the unpainted character portion 11*c* can be lighted more uniformly in comparison to the first exemplary embodiment. It will be noted that, in the third exemplary embodiment also, the rubber dome 14 may be formed by a transparent material in the same manner as in the second exemplary embodiment. Further, the backlight unit 21 may also be configured such that, instead of the fluorescent tube 21 serving as a light emitting source being disposed on the end portion of the reflective plate 21*b*, plural fluorescent tubes are disposed evenly at plural places inside the reflective plate.

Figure 11:
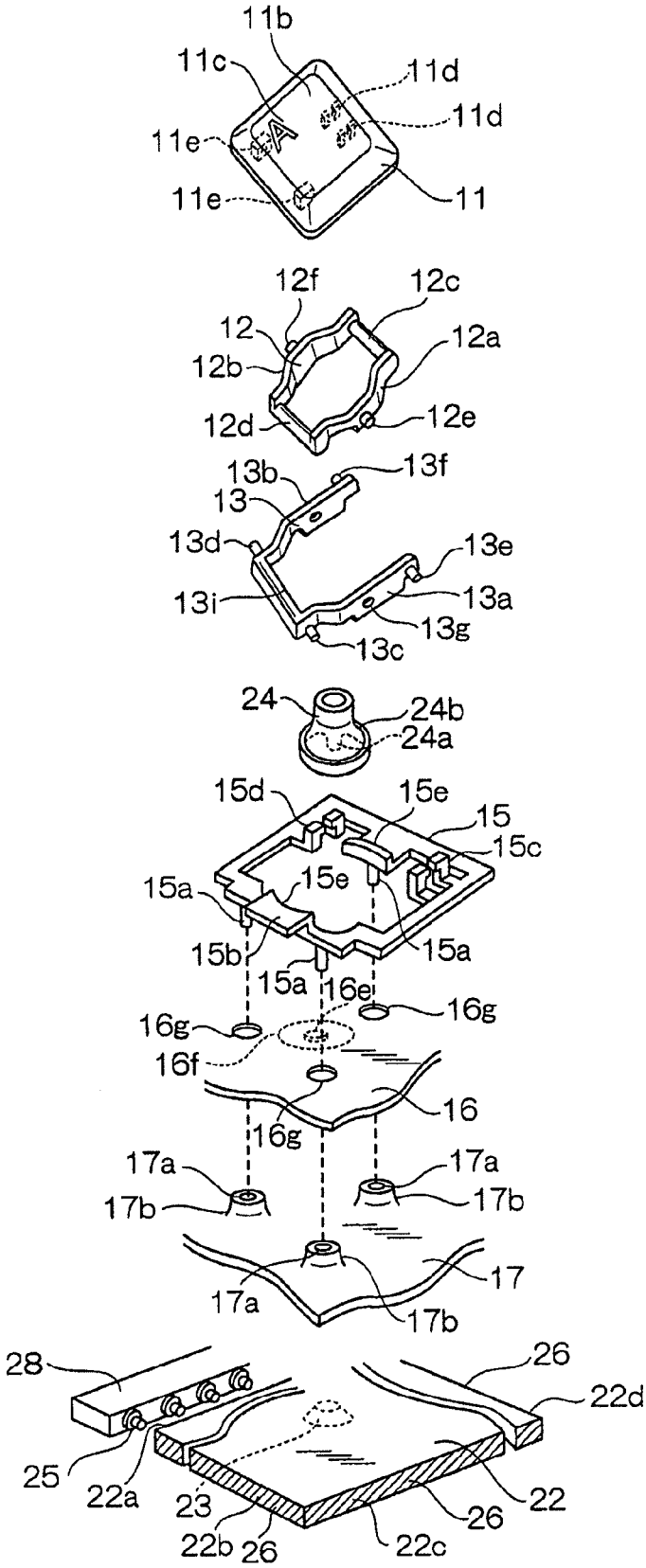
FIG. 11 is an exploded perspective diagram showing a key switch structure of a fourth exemplary embodiment.

Next, a fourth exemplary embodiment will be described. FIG. 11 is an exploded perspective diagram showing a key switch structure of the fourth exemplary embodiment. In FIG. 11, similar to the first exemplary embodiment, a key top 11 includes: a body portion 11*a* formed by a transparent or semitransparent resin whose degree of permeability to light has been optionally adjusted; a painted portion 11*b* that is formed on the upper part of the body portion 11*a* and to which has been applied paint of a single color or numerous colors adjusted in order to control permeability to light; and an unpainted character portion 11*c* on which an unpainted character or an unpainted symbol has been formed by removing paint in the form of a character or symbol by laser marking or the like.

A rubber dome 24 is formed in a substantial cup shape by a transparent material, and a contact depression portion 24*a* is formed protruding downward in the center portion of the inner surface of the rubber dome 24. Fine protrusions—depressions 24*b* are formed in the surface of the rubber dome 24.

Figure 12:
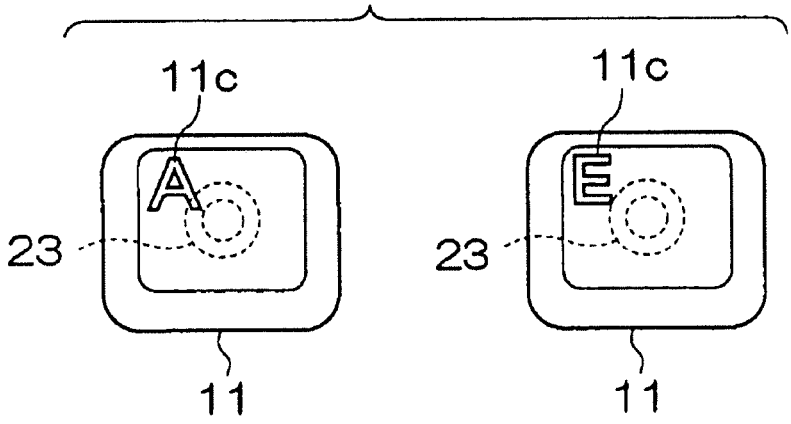
FIG. 12 is an explanatory diagram showing positional relationships between key tops and reflective portions.
Figure 13:
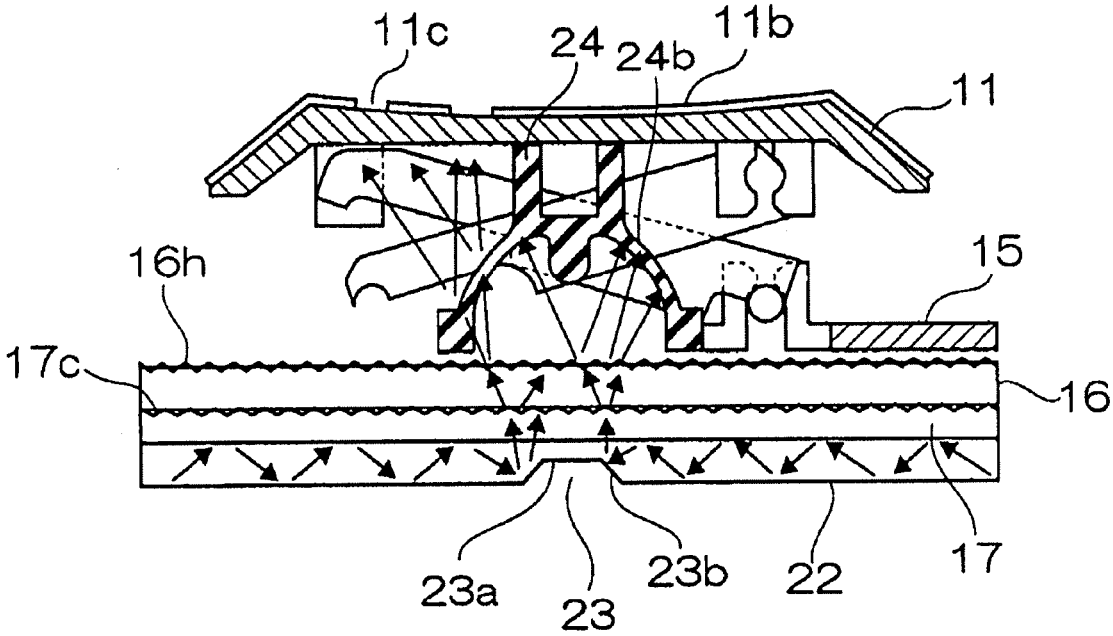
FIG. 13 is an explanatory diagram showing a lighted state in the fourth exemplary embodiment.

A light guide plate 22 is disposed below the back plate 17. The light guide plate 22 is formed by a resin having high transparency, and light passes inside while bending. Plural reflective portions 23 are formed in the light guide plate 22. As shown in FIG. 12, the reflective portions 23 are disposed directly below the center portions of the key tops 11. Further, as shown in FIG. 13, each of the reflective portions 23 is formed in a conical shape, and an upper surface 23*a* and a side surface 23*b* thereof serve as light reflecting surfaces. FIG. 12 is an explanatory diagram showing positional relationships between the key tops and the reflective portions, and FIG. 13 is an explanatory diagram showing a lighted state in the fourth exemplary embodiment.

In FIG. 11, an LED array 28 is disposed on one end portion of the light guide plate 22. The LED array 28 comprises plural LED light sources 25 that are arranged in a row along the surface of the light guide plate 22, and the LED array 28 emits light with respect to one side surface 22*a* of the light guide plate 22. Further, a reflective member 26 is disposed on other side surfaces 22*b*, 22*c*, and 22*d* of the light guide plate 22. The remaining configuration is the same as that of the first exemplary embodiment.

In FIG. 13, the LED array 28 disposed facing the one side surface 22*a* of the light guide plate 22 lights up when an unillustrated power source is turned ON. The light emitted from the LED array 28 bends while passing through the inside of the light guide plate 22. The light is reflected by the upper surface 23*a* and the side surface 23*b* of the reflective portion 23 formed directly below the center portion of the key top 11, and some of the reflected light enters the back plate 17. Because the side surface 23*b* is formed diagonally slanting, the light passing through the light guide plate 22 is reflected in the direction of the back plate 17.

Further, the light that does not strike the reflective portion 23 is reflected by the reflective member 26 disposed on the side surfaces 22*b*, 22*c*, and 22*d*. The light reflected by the reflective member 26 again passes through the inside of the light guide plate 22, and some of that light is reflected by the reflective portion 23. As a result of this process being repeated, a relatively large amount of light enters the back plate 17.

The light entering the back plate 17 passes upward through the back plate 17 that is formed by a transparent resin and is diffused by the protrusion—depression shape 17*c* when it emerges from the back plate 17. The light passing through the back plate 17 passes through the membrane sheet 16 because the membrane sheet 16 is permeable to light. The light passing at this time is again diffused by the protrusions—depressions 16*h* in the surface of the membrane sheet 16 when it emerges from the membrane sheet 16. Additionally, some of the diffused light enters the inside of the rubber dome 24 and passes through the rubber dome 24. The light passing at this time is further diffused by the protrusions—depressions 24*b* in the surface of the rubber dome 24 when it emerges from the rubber dome 24. The diffused light slips through the first link member 12 and the second link member 13 and reaches the underside of the key top 11.

The unpainted character portion 11*c* is formed on the key top 11, and when light strikes the unpainted character portion 11*c*, the shape of the character or symbol formed on the upper surface of the key top 11 is lighted and can be seen.

In this manner, in the fourth exemplary embodiment, effects that are the same as those of the second exemplary embodiment can be provided. Further, in the fourth exemplary embodiment, it becomes possible to reduce the cost of the LED and the cost for attaching the LED because the number of LEDs is fewer in comparison to the second exemplary embodiment where LEDs are disposed in correspondence to the number of keys, so that an inexpensive lighted keyboard can be realized.

Figure 14:
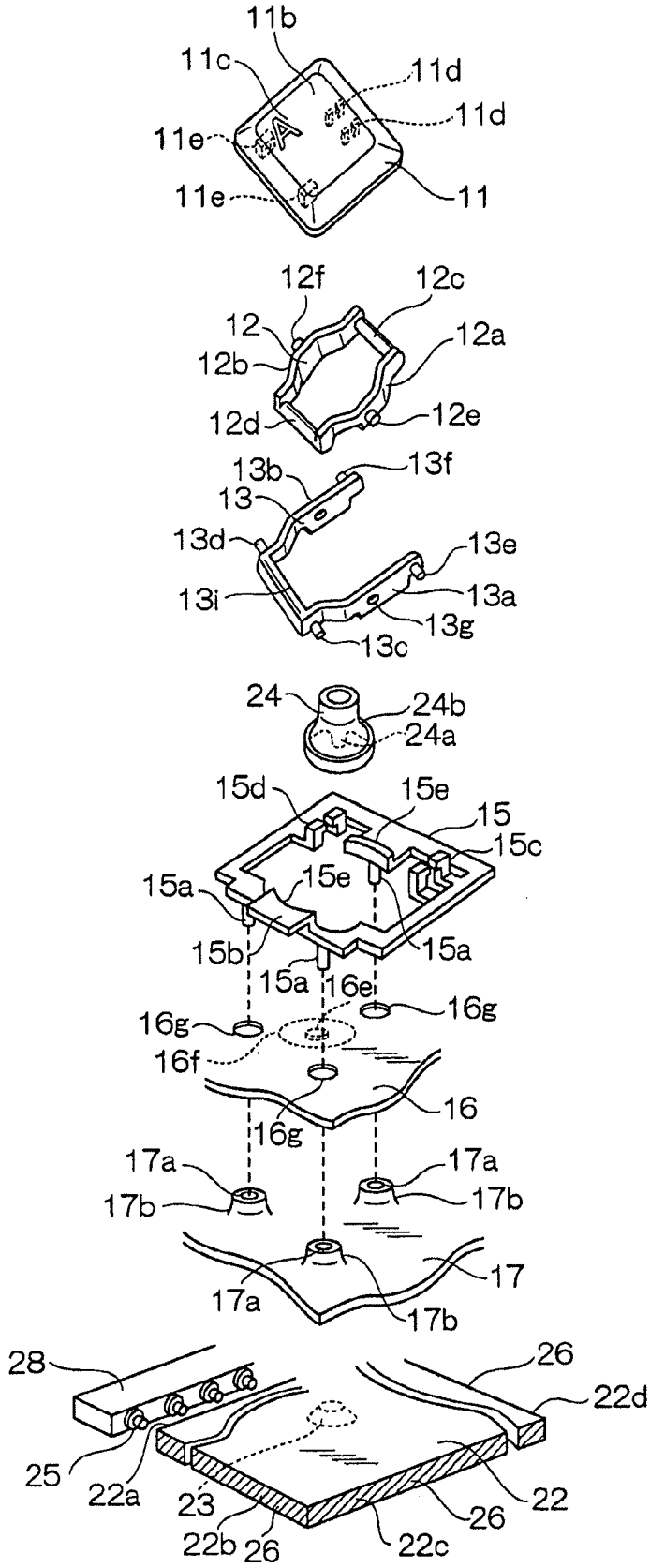
FIG. 14 is an exploded perspective diagram showing a key switch structure of a fifth exemplary embodiment.

Next, a fifth exemplary embodiment will be described. FIG. 14 is an exploded perspective diagram showing a key switch structure of the fifth exemplary embodiment. In FIG. 14, similar to the first exemplary embodiment, a key top 11 includes: a body portion 11*a* formed by a transparent or semitransparent resin whose degree of permeability to light has been optionally adjusted; a painted portion 11*b* that is formed on the upper part of the body portion 11*a* and to which has been applied paint of a single color or numerous colors adjusted in order to control permeability to light; and an unpainted character portion 11*c* on which an unpainted character or an unpainted symbol has been formed by removing paint in the form of a character or symbol by laser marking or the like.

Figure 15:
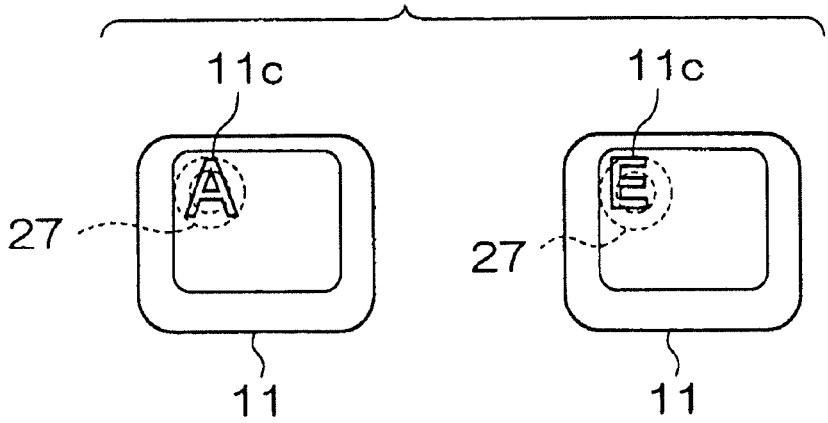
FIG. 15 is an explanatory diagram showing positional relationships between key tops and reflective portions.
Figure 16:
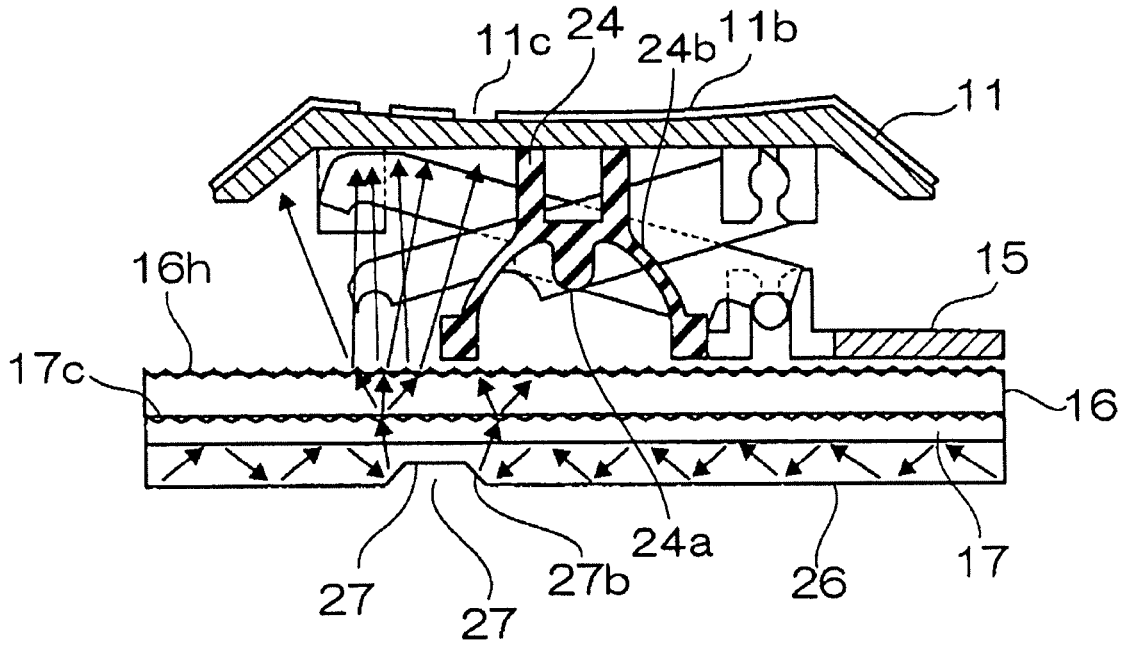
FIG. 16 is an explanatory diagram showing a lighted state in the fifth exemplary embodiment.
Figure 17:
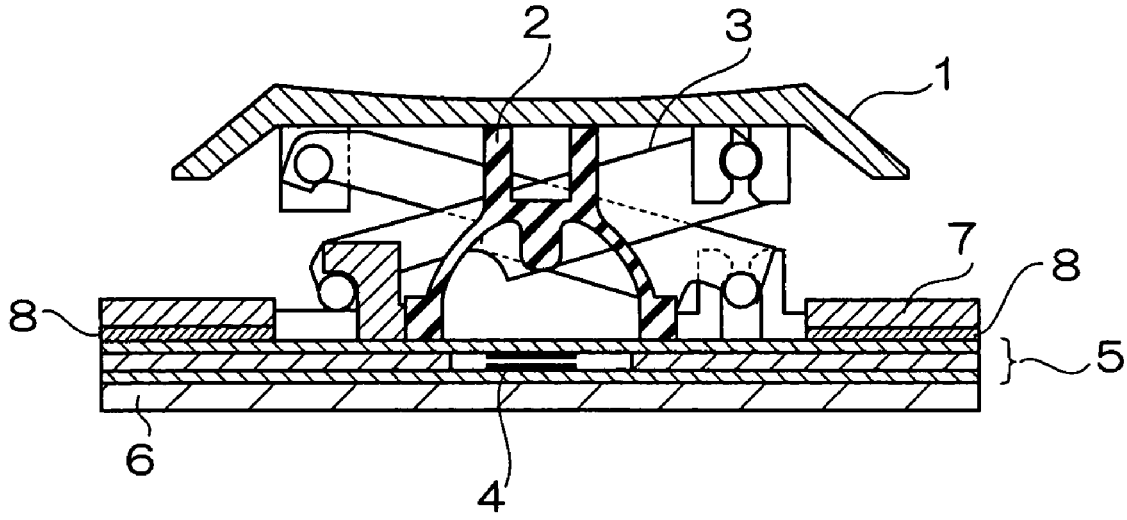
FIG. 17 RELATED ART
FIG. 17 is a cross-sectional diagram showing a conventional key switch structure.

Similar to the fourth exemplary embodiment, a light guide plate 22 is disposed below the back plate 17. The light guide plate 22 is formed by a resin having high transparency, and light passes inside while bending. Plural reflective portions 27 are formed in the light guide plate 22. As shown in FIG. 15, the reflective portions 27 are disposed directly below the unpainted character portions 11*c* of the key tops 11. Further, as shown in FIG. 16, each of the reflective portions 27 is formed in a conical shape, and an upper surface 27*a* and a side surface 27*b* thereof serve as light reflecting surfaces. FIG. 15 is an explanatory diagram showing positional relationships between the key tops and the reflective portions, and FIG. 16 is an explanatory diagram showing a lighted state in the fifth exemplary embodiment.

In FIG. 14, similar to the fourth exemplary embodiment, an LED array 28 is disposed on one end portion of the light guide plate 22. The LED array 28 comprises plural LED light sources 25 that are arranged in a row along the surface of the light guide plate 22, and the LED array 28 emits light with respect to one side surface 22*a* of the light guide plate 22. Further, a reflective member 26 is disposed on other side surfaces 22*b*, 22*c*, and 22*d* of the light guide plate 22.

In FIG. 16, the LED array 28 disposed facing the one side surface 22*a* of the light guide plate 22 lights up when an unillustrated power source is turned ON. The light emitted from the LED array 28 bends while passing through the inside of the light guide plate 22. The light is reflected by the upper surface 27*a* and the side surface 27*b* of the reflective portion 27 formed directly below the unpainted character portion 11*c* of the key top 11, and some of the reflected light enters the back plate 17. Because the side surface 27*b* is formed diagonally slanting, the light passing through the light guide plate 22 is reflected in the direction of the back plate 17.

The light that does not strike the reflective portions 27 is reflected by the reflective member 26 disposed on the side surfaces 22*b*, 22*c*, and 22*d*. The light reflected by the reflective member 26 again passes through the inside of the light guide plate 22, and some of that light is reflected by the reflective portion 27. As a result of this process being repeated, a relatively large amount of light enters the back plate 17.

The light entering the back plate 17 passes upward through the back plate 17 that is formed by a transparent resin and is diffused by the protrusion—depression shape 17*c* when it emerges from the back plate 17. The light passing through the back plate 17 passes through the membrane sheet 16 because the membrane sheet 16 is permeable to light. The light passing at this time is again diffused by the protrusions—depressions 16*h* in the surface of the membrane sheet 16 when it emerges from the membrane sheet 16. Additionally, some of the diffused light slips through the first link member 12 and the second link member 13 from the outside of the rubber dome 14 and reaches the underside of the key top 11.

The unpainted character portion 11*c* is formed on the key top 11, and when light strikes the unpainted character portion 11*c*, the shape of the character or symbol formed on the upper surface of the key top 11 is lighted and can be seen.

According to the fifth exemplary embodiment, effects that are the same as those of the first exemplary embodiment can be provided. Further, in the fifth exemplary embodiment, it becomes possible to reduce the cost of the LED and the cost for attaching the LED because the number of LEDs is fewer in comparison to the first exemplary embodiment where LEDs are disposed in correspondence to the number of keys, so that an inexpensive lighted keyboard can be realized.

Exemplary embodiments of the present invention are described above, but the present invention is not limited to the exemplary embodiments as will be clear to those skilled in the art.

Namely, a first aspect of the present invention provides a key switch structure comprising: a key top on which an unpainted character portion that is permeable to light is formed; a membrane sheet that comprises a contact portion and is permeable to light; a plate member that is disposed below the membrane sheet and is permeable to light; and a light source disposed below the plate member, wherein the unpainted character portion of the key top is lighted via the plate member and the membrane sheet by causing the light source to emit light.

According to the first aspect, by forming a membrane sheet that is permeable to light, disposing a plate member that is permeable to light below the membrane sheet, and disposing a light source substantially directly below a key top, a lighted state that is uniform and good is obtained. Further, by using a light emitting diode as the light source, a device whose lighting lifespan is long and which is inexpensive is obtained.

What is claimed is:

1. A key switch structure comprising:

a key top on which an unpainted character portion that is permeable to light is formed;

a membrane sheet that comprises a contact portion and is entirely permeable to light;

a plate member that is disposed below the membrane sheet and is entirely permeable to light, wherein the plate member contacts the membrane sheet;

a light guide member, having a top side, bottom side, and a first side, the light guide member being disposed below the plate member, the light guide member having a conical recess, the conical recess being disposed below the unpainted character portion of the key top, the conical recess having a base located along the bottom side of the light guide member and a top which extends toward the unpainted character portion of the key top;

a light source disposed below the plate member and adjacent to the first side of the light guide member, wherein light from the light source travels through the light guide member in a direction parallel to the top side of the light guide member; and a reflective portion disposed below the light guide member and flush with the bottom side of the light guide, the reflective portion having a conical shape, the reflective portion disposed within the conical recess of the light guide member, the reflective portion being adapted to reflect light towards the key top, wherein the unpainted character portion of the key top is lighted via light from the light source, wherein the light is diffused by both the plate member and the membrane sheet.

2. The key switch structure of claim 1, wherein the light emitted from the light source reaches the unpainted character portion after being diffused by protrusions—depressions in the plate member and the membrane sheet.

3. The key switch structure of claim 1, wherein the light source comprises a light emitting diode.

4. The key switch structure of claim 1, wherein the conical shaped portion includes a sloped side angled away from the second side of the light guide and adapted to reflect light towards the key top.

5. The key switch structure of claim 1, further comprising an elastic member that is disposed between the key top and the membrane sheet, is formed from a member that is permeable to light, and causes the key top that has been depressed to return to its original portion.

6. The key switch structure of claim 5, wherein the light emitted from the light source reaches the unpainted character portion of the key top after being diffused by protrusions—depressions in the plate member, the membrane sheet, and the elastic member.

7. The key switch structure of claim 5, wherein the elastic member comprises rubber.

8. The key switch structure of claim 1, further comprising a light guide plate disposed below the plate member, wherein the light source comprises light emitting element portions that are arrayed on one end portion of the light guide plate and emit light in the surface direction of the light guide plate.

9. The key switch structure of claim 8, further comprising an elastic member that is disposed between the key top and the membrane sheet, is permeable to light, and causes the key top that has been depressed to return to its original position.

10. The key switch structure of claim 8, wherein the light emitting element portions comprise light emitting diodes.

11. A key switch structure comprising:

a key top on which an unpainted character portion that is permeable to light is formed;

a membrane sheet that comprises a contact portion, is entirely permeable to light, and comprises a surface at the key top side in which protrusions—depressions are formed;

a plate member that is disposed below the membrane sheet, is entirely permeable to light, and comprises a surface at the key top side in which protrusions—depressions are formed, wherein the plate member contacts the membrane sheet;

a light guide member, having a top side and a bottom side, and a first side, the light guide member being disposed below the plate member, the light guide member having a conical recess, the conical recess being disposed below the unpainted character portion of the key top, the conical recess having a base located along the bottom side of the light guide member and a top which extends toward the unpainted character portion of the key top;

a light source disposed below the plate member and adjacent to the first side of the light guide member, wherein light from the light source travels through the light guide member in a direction parallel to the top side of the light guide member, a reflective portion disposed below the light guide member and flush with the bottom side of the light guide, the reflective portion having a conical shape, the reflective portion disposed within the conical recess of the light guide member, the reflective portion being adapted to reflect light towards the key top, wherein the light from the light source reaches and lights the unpainted character portion after being diffused by the protrusions—depressions in both the plate member and the membrane sheet.

12. The key switch structure of claim 11, wherein the conical shaped portion includes a sloped side angled away from the second side of the light guide and adapted to reflect light towards the key top.

13. The key switch structure of claim 11, further comprising an elastic member that is disposed between the key top and the membrane sheet, is formed from a member that is permeable to light, comprises a surface in which protrusions—depressions are formed, and causes the key top that has been depressed to return to its original position, wherein the light diffused from the light source reaches the unpainted character portion of the key top after being diffused by the protrusions —depressions in the plate member, the membrane sheet, and the elastic member.

14. The key switch structure of claim 13, wherein the elastic member comprises rubber, is formed in a substantial cup shape such that its opening is at the membrane sheet side, and with a contact depression portion corresponding to the contact portion being formed so as to protrude from its bottom portion; and the light source is disposed substantially directly below the contact portion of the membrane sheet.

* * * * *

UNITED STATES PATENT AND TRADEMARK OFFICE

CERTIFICATE OF CORRECTION

PATENT NO. : 7,525,056 B2
APPLICATION NO. : 11/706973
DATED : April 28, 2009
INVENTOR(S) : Chiba et al.

It is certified that error appears in the above-identified patent and that said Letters Patent is hereby corrected as shown below:

In the Drawings:

Sheet 2 of 12, insert Fig. 3B:

FIG. 3B

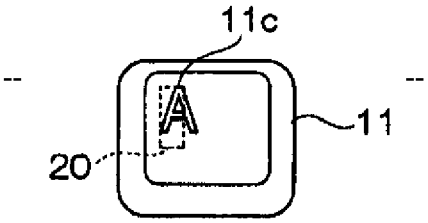

Signed and Sealed this

Twenty-third Day of June, 2009

John Doll

JOHN DOLL
*Acting Director of the United States Patent and Trademark Office*